US005255899A

United States Patent [19]

von Grozny

[11] Patent Number: 5,255,899

[45] Date of Patent: Oct. 26, 1993

[54] FENCING SYSTEM

[75] Inventor: James F. G. von Grozny, Cornwall, United Kingdom

[73] Assignee: Duralock (UK) Ltd., Cornwall, England

[21] Appl. No.: 915,595

[22] Filed: Jul. 21, 1992

[51] Int. Cl.[5] ..... E04H 17/22; E02D 27/42

[52] U.S. Cl. ..... 256/59; 256/65; 256/1

[58] Field of Search ..... 256/1, 19, 24, 59, 65, 256/66; 52/155, 165

[56] References Cited

U.S. PATENT DOCUMENTS 4,072,294 2/1978 Densen ..... 256/24
4,477,058 10/1984 Lowery ..... 256/19
4,702,459 10/1987 Moschner .
4,722,514 2/1988 Pettit .
4,809,955 3/1989 Veilleax .

FOREIGN PATENT DOCUMENTS 2-183061 7/1990 Japan ..... 256/1
1233304 5/1971 United Kingdom .
1482517 8/1977 United Kingdom .

*Primary Examiner*—Randolph A. Reese
*Assistant Examiner*—Christopher J. Novosad
*Attorney, Agent, or Firm*—Larson and Taylor

[57] ABSTRACT

A fencing system comprises hollow posts of UPVC, preferably divided in two longitudinal compartments, one compartment for fitting loosely over a ground-engaging spike and securing with a settable material, and the other compartment for receiving the ends of rails via apertures formed in opposed faces or walls of the posts.

16 Claims, 2 Drawing Sheets

FENCING SYSTEM

Figure 1:
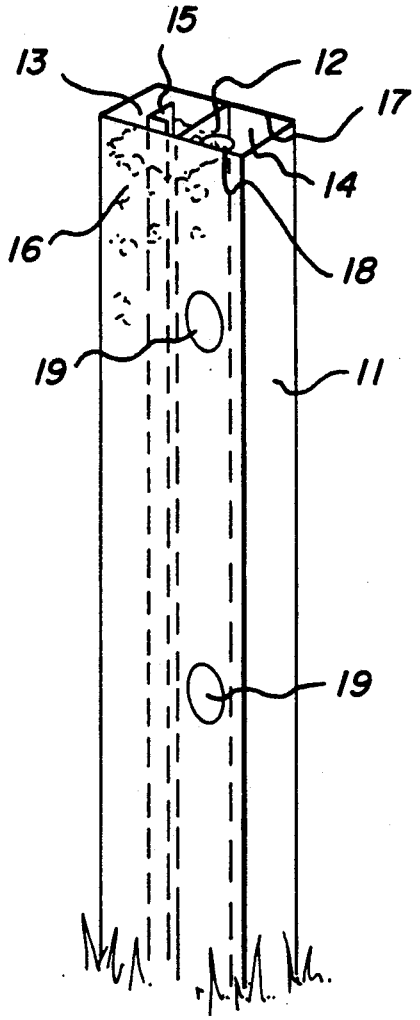

This invention relates to fencing systems suitable for use for confining animals or livestock in fields, parks, race-courses and the like.

Traditional "post and rail" fencing systems are commonly used by farmers and others to define boundaries and to confine or restrain animals or livestock in predetermined zones or areas. Such systems include upright wooden posts set in the ground, generally with concrete, adjacent posts being spanned by one or more wooden rails which are fixed to the posts by tying, nailing or by means of a mortice joint. However, fencing of this type is expensive to acquire and erect, in that the posts need to be set deep in the ground for stability and must be precisely positioned. Furthermore, timber is liable to decompose and be subject to attack by pests and fungi, which restricts its lifespan often to ten years or less. Finally, timber is inherently unsuitable for use with animals since it harbours disease and infection and is chewable.

It is an object of the present invention to provide a fencing system which alleviates the disadvantages of traditional post and rail fencing.

According to the invention, a fencing system comprises post members and rails for spanning between adjacent post members in use, in which the post members comprise an enclosed hollow section and have apertures formed in the wall to receive the rails.

The hollow section post members, which are preferably of rectangular or box section, enables them to be erected by locating individual posts over respective support elements previously inserted in the ground. Suitable support elements include metal, for example galvanized steel, spikes which may be provided with wing portions or other stabilising means to engage the ground to resist lateral movement at a lower end portion, the upper end portion in use extending within the cavity of the post provided by the hollow section. Preferably the cavity is over-sized in cross section in relation to the support elements, whereby the posts are a lateral loose fit over the support elements. Each support element may thus be inserted in the ground in the approximately-correct location, the respective post being subsequently adjustable within the limits provided by the loose fit and ultimately secured in place by pouring a settable material into the cavity to surround the upper end portion of the support element, the settable material then being allowed to set or cure.

It is preferred that the post members are divided into two internal longitudinal compartments by a web element, one of said compartments being for locating over the support elements and the other for receiving the rails. In such an arrangement, the support element may extend in one compartment substantially to the top of the post for maximum stability, without interfering with the rails which are received in the other compartment.

The invention also includes a kit of parts for a fencing system, the kit comprising a ground-engageable support element including a portion which in use extends substantially vertically above the surface of the ground; a post member comprising an enclosed hollow section and suitable for locating over said portion of the support element; and rails which are receivable within apertures formed in the wall of the post member.

Preferably, a fencing system according to the invention also includes cap members which are receivable within the upper ends of the post members, to improve the appearance and also to exclude rain.

According to a further aspect, the invention includes a method of erecting a fencing system, the method including the steps of inserting a support element for a fencing post in the ground at a desired location for said post, so that a portion of said support element extends upwardly above ground level; locating a post member comprising an enclosed hollow section over said upwardly-extending portion and if necessary laterally adjusting the position of said post member relative to said support element; introducing a settable material within said box section to fill at least the lower end region thereof and to surround said upwardly-extending support element portion within said hollow section; allowing said settable material to set to secure the post member to the support element; and introducing fencing rails between adjacent post members thus secured at respective locations, the rails being received within apertures formed in the walls of said post members.

The rails may be of any desired cross-sectional shape but preferably have a cross-sectional profile which is curved and excludes corners, for example elliptical, thus rendering the rails more resistant to being chewed by livestock. Apertures formed in the walls of the posts for the purpose of receiving the rails are preferably shaped and sized to receive the rails with a degree of tolerance which permits insertion of the rail ends within the apertures while preventing slackness or a tendency for the assembled fencing system to become partially disassembled by, for example, rubbing contact with animals. For most purposes, the apertures formed in the walls of the posts will be in opposed walls or wall faces and in aligned pairs, whereby rail ends are insertible from opposite directions and the resulting assembled fence appears to have continuous rails through the posts, the respective ends being within the hollow post or the rail compartment thereof. Of course, with such an arrangement, a single rail may indeed be passed through the apertures to extend on each side of the post. For corner purposes, on the other hand, apertures may be formed mutually at 90°, for example, or for an end post apertures may be formed in only one face or wall of the post member.

Post members, rails and cap members may be made from any suitable material but it is preferred to form them from uPVC. This material, commonly used for window frames and the like, is strong, weather-resistant and may readily be worked by extrusion to form post members and rails and by cutting or milling to form apertures in the post members.

Figure 2:
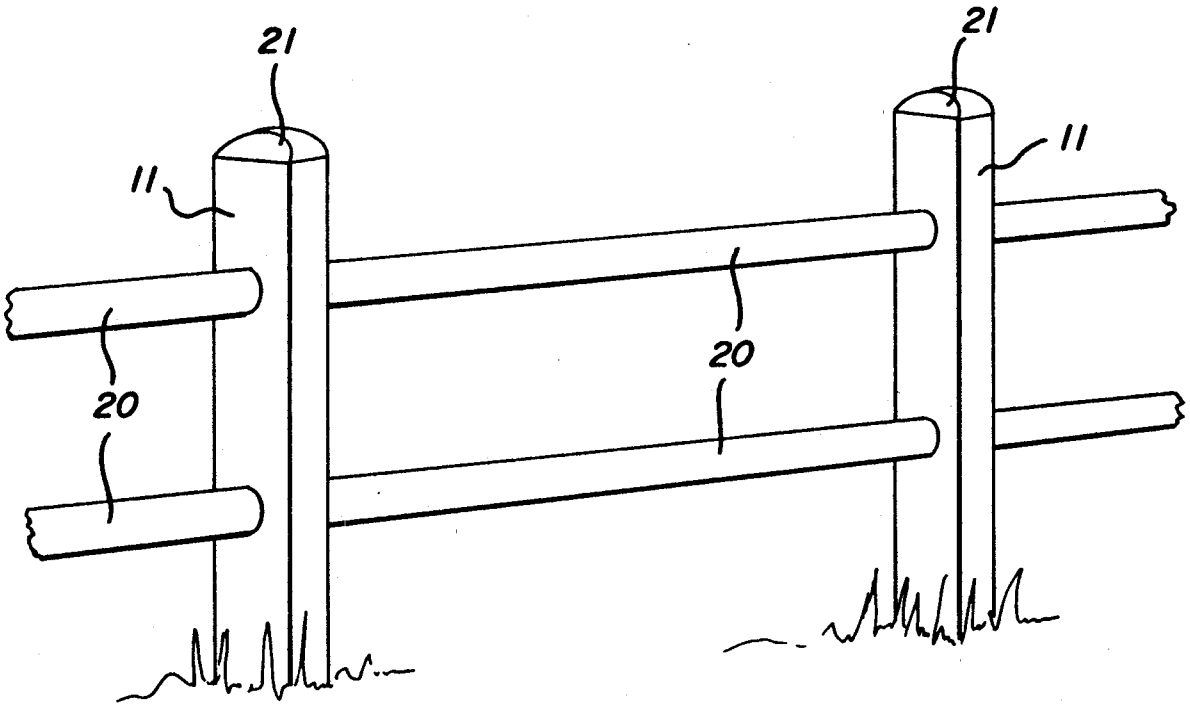

Embodiments of the invention will now be described by way of example with reference to the accompanying drawings, of which FIG. 1 is a perspective view of a post member in the erected condition but without rails or cap member, and FIG. 2 is a perspective view of two post members each as shown in FIG. 1 with rails and cap member fitted.

Referring to FIG. 1, a post member consists of UPVC rectangular extrusion 11 divided by internal web 12 into two longitudinal compartments 13, 14. Compartment 13 is for fitting over and around a support element 15 driven in the ground and secured by concrete 16, introduced at the upper end of the compartment 13 and allowed to harden. Opposed walls 17, 18 of compartment 14 have apertures 19 formed therein.

Referring to FIG. 2, rails 20 are inserted from each side of the post in the apertures 19 and the open end of the post member has a cap 21 inserted therein.

I claim:

1. A fencing system comprising post members and rails for spanning between adjacent post members in use, in which the post members comprise an enclosed hollow section, a web member transversely and longitudinally extending across said hollow section and defining an internal longitudinal first compartment in said hollow section having an opening at one end of said post member, and an internal longitudinal second compartment in said hollow section transversely separated from said first compartment by said web member, said second compartment having opposed outer walls which extend away from said web member, said second compartment outer walls having apertures formed therein of a size and configuration so as to be able to receive an end portion of the rails; and ground-engageable support elements which in use extend through said end opening into only said first compartment of said post members.

2. A fencing system according to claim 1, in which the post members are of rectangular cross-section.

3. A kit of parts for a fencing system according to claim 1 in which the support elements comprise metal spikes.

4. A kit of parts for a fencing system according to claim 1 in which the cavity is over-sized in relation to the support elements.

5. A kit of parts for a fencing system according to claim 1, further including capping members which are receivable within the other ends of the post members.

6. A kit of parts for a fencing system according to claim 1, wherein said post members have a rectangular cross-section so that said post members have an elongate box shape.

7. A kit of parts for a fencing system according to claim 6, wherein said post members are UPVC rectangular extrusions and said longitudinal compartments extend completely through said post members.

8. A kit of parts for a fencing system according to claim 7, further including capping members which are receivable within the other ends of the post members.

9. A kit of parts for a fencing system, the kit comprising a ground-engageable support element including a portion which in use extends substantially vertically above the surface of the ground;

a post member comprising an enclosed hollow section and a web member transversely and longitudinally extending across said hollow section and defining an internal longitudinal first compartment in said hollow section having an opening at one end of said post member for receiving said portion of said support element through said opening, and an internal longitudinal second compartment in said hollow section transversely separated from said first compartment by said web member, said second compartment having opposed outer walls which extend away from said web member, said second compartment outer walls having apertures formed in said walls;

and rails, each rail having an end portion which is receivable within said post member through said apertures in said second compartment walls.

10. A kit of parts for a fencing system according to claim 9 in which the support elements comprise metal spikes.

11. A kit of parts for a fencing system according to claim 9 in which the cavity is over-sized in relation to the support elements.

12. A kit of parts for a fencing system according to claim 9, further including capping members which are receivable within the other ends of the post members.

13. A kit of parts for a fencing system according to claim 9, wherein said post members have a rectangular cross-section so that said post members have an elongate box shape.

14. A kit of parts for a fencing system according to claim 13, wherein said post members are UPVC rectangular extrusions and said longitudinal compartments extend completely through said post members.

15. A kit of parts for a fencing system according to claim 14, further including capping members which are receivable within the other ends of the post members.

16. The method of erecting a fencing system, the method including the steps of inserting a support element for a fencing post in the ground at a desired location for said post, so that a portion of said support element extends upwardly above ground level;

providing a post member comprising an enclosed hollow section, a web member transversely and longitudinally extending across said hollow section and defining an internal longitudinal first compartment in said hollow section having an opening at one end of said post member, and an internal longitudinal second compartment in said hollow section transversely separated from said first compartment by said web member, said second compartment having opposed outer walls which extend away from said web member, said second compartment outer walls having apertures formed therein of a size and configuration so as to be able to receive an end portion of the rails;

locating said one end of said first compartment over said upwardly-extending portion and if necessary laterally adjusting the position of said post member relative to said support element;

introducing a settable material within said first compartment to fill at least the lower end region thereof and to surround said upwardly-extending support element portion within said first compartment;

allowing said settable material to set to secure the post member to the support element;

and introducing fencing rails between adjacent post members thus secured at respective locations, an end portion of said rails being received within said apertures formed in the walls of said second compartment of said post members.

* * * * *